US010100566B1

(12) United States Patent
Chandra

(10) Patent No.: US 10,100,566 B1
(45) Date of Patent: Oct. 16, 2018

(54) CONCEALED DOOR OPENING SYSTEM

(71) Applicant: Suwandi Chandra, Southlake, TX (US)

(72) Inventor: Suwandi Chandra, Southlake, TX (US)

( * ) Notice: Subject to any disclaimer, the term of this patent is extended or adjusted under 35 U.S.C. 154(b) by 16 days.

(21) Appl. No.: 15/704,840

(22) Filed: Sep. 14, 2017

Related U.S. Application Data

(60) Provisional application No. 62/394,321, filed on Sep. 14, 2016.

(51) Int. Cl.

| | |
|---|---|
| ***E05B 53/00*** | (2006.01) |
| ***E05F 11/54*** | (2006.01) |
| ***E05B 1/00*** | (2006.01) |
| ***E05F 5/02*** | (2006.01) |
| ***E05B 17/00*** | (2006.01) |

(52) U.S. Cl.
CPC ..... *E05F 11/54* (2013.01); *E05B 1/0053* (2013.01); *E05B 17/0033* (2013.01); *E05B 53/001* (2013.01); *E05F 5/02* (2013.01); *E05Y 2900/20* (2013.01)

(58) Field of Classification Search
CPC ..... E05F 11/54; E05F 5/02; E05B 17/0033; E05B 17/0058
USPC ..... 312/319.9; 49/263; 292/336.3
See application file for complete search history.

(56) References Cited

U.S. PATENT DOCUMENTS 3,012,837 A * 12/1961 Morrissey, Jr. ..... E05B 17/0033 49/276
3,030,102 A * 4/1962 Smith ..... E05B 53/001 292/198
3,980,326 A * 9/1976 Smith ..... E05B 65/0014 292/86
4,068,872 A * 1/1978 Smith ..... E05B 53/001 292/255
4,911,508 A * 3/1990 Tillman ..... E05B 17/0033 292/255
5,556,141 A * 9/1996 Rogers ..... E05B 65/0014 292/303
5,622,416 A * 4/1997 Rainey ..... A47B 96/00 292/255
5,975,593 A * 11/1999 Cress ..... E05B 53/001 292/101
5,975,662 A * 11/1999 Weber ..... A47B 88/463 292/251.5
6,328,392 B1 * 12/2001 Whitcomb ..... E05B 17/0033 312/319.1
6,382,750 B1 * 5/2002 King ..... A47B 95/00 16/901

(Continued)

FOREIGN PATENT DOCUMENTS

CA 2641400 A1 * 4/2010 ..... E05B 1/0053
WO WO-2014026506 A1 * 2/2014 ..... E05B 53/001

*Primary Examiner* — Kimberley S Wright
(74) *Attorney, Agent, or Firm* — Richard G Eldredge

(57) ABSTRACT

A cabinet structure includes a frame having a plurality of panels; a door pivotally secure to a panel of the plurality of panels; a foot bracket secured to the door, the foot bracket forming a c-shaped structure having an opening configured to receive a foot therein; a door stop secured to an outer surface of the foot bracket and configured to engage with the frame and configured to secure the door in a locked positioned; and a foot grip disposed within the opening of the foot bracket and configured to engage with the foot.

1 Claim, 3 Drawing Sheets

(56) References Cited

U.S. PATENT DOCUMENTS

| | | | | |
|---|---|---|---|---|
| 6,533,375 | B2 * | 3/2003 | Fulterer | H03K 17/968 250/221 |
| 7,043,799 | B2 * | 5/2006 | Moody | E05B 53/001 16/412 |
| 9,115,530 | B2 * | 8/2015 | Michael | E05F 11/54 |
| 9,822,572 | B2 * | 11/2017 | Brown | E05F 11/54 |
| 2001/0013745 | A1 * | 8/2001 | Fulterer | H03K 17/968 312/319.5 |
| 2003/0001471 | A1 * | 1/2003 | Libby | E05L 31/0015 312/319.8 |
| 2004/0201338 | A1 * | 10/2004 | Mouw | B65F 1/1436 312/319.9 |
| 2004/0261226 | A1 * | 12/2004 | Moody | E05B 53/001 16/413 |
| 2005/0005402 | A1 * | 1/2005 | Moody | E05B 53/001 16/413 |
| 2009/0145037 | A1 * | 6/2009 | Michael | E05F 11/54 49/359 |
| 2014/0197648 | A1 * | 7/2014 | Brown | E05F 11/54 292/336.3 |
| 2016/0076295 | A1 * | 3/2016 | Boyd | E05F 13/02 49/264 |

* cited by examiner

CONCEALED DOOR OPENING SYSTEM

BACKGROUND

1. Field of the Invention

The present invention relates generally to door systems, and more specifically, to a door opening system for moving the barrier from an entrance way.

2. Description of Related Art

Door systems are well known in the art and are effective means to close a space used as an entrance. For example, FIG. 1 depicts a conventional door opening system 101 having a handle 103, a door 105, a frame 107 and a user 109. During use, the handle 103 is pulled by the user 109 causing the door 105 to leave the proximity of the frame 107.

One of the problems commonly associated with system 101 is its limited safety. For example, the handle 103 must be attached so as to protrude from the door 105, potentially resulting in bruises and other injury to the user 109.

Accordingly, although great strides have been made in the area of door opening systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
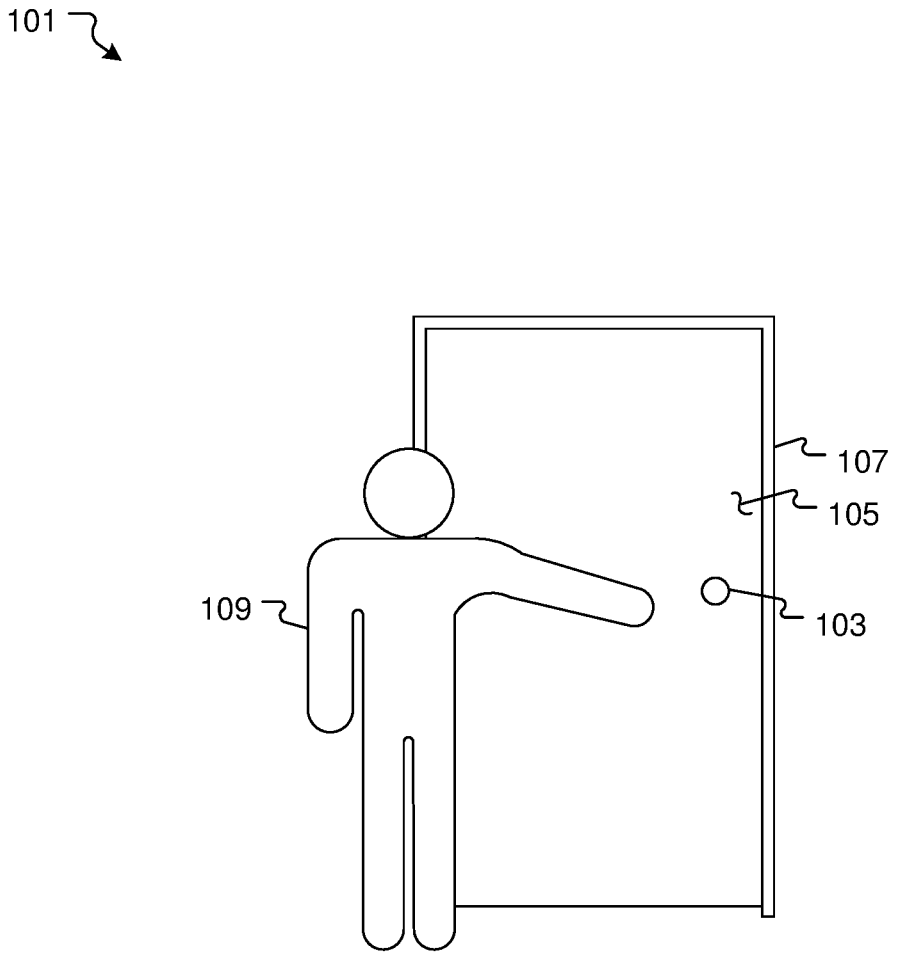
FIG. 1 (Prior Art)
FIG. 1 is a front view of a common door opening system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional door opening systems. Specifically, the system of the present application provides means to attach a handle to a door so that the handle reduces the risk of injury to the user. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
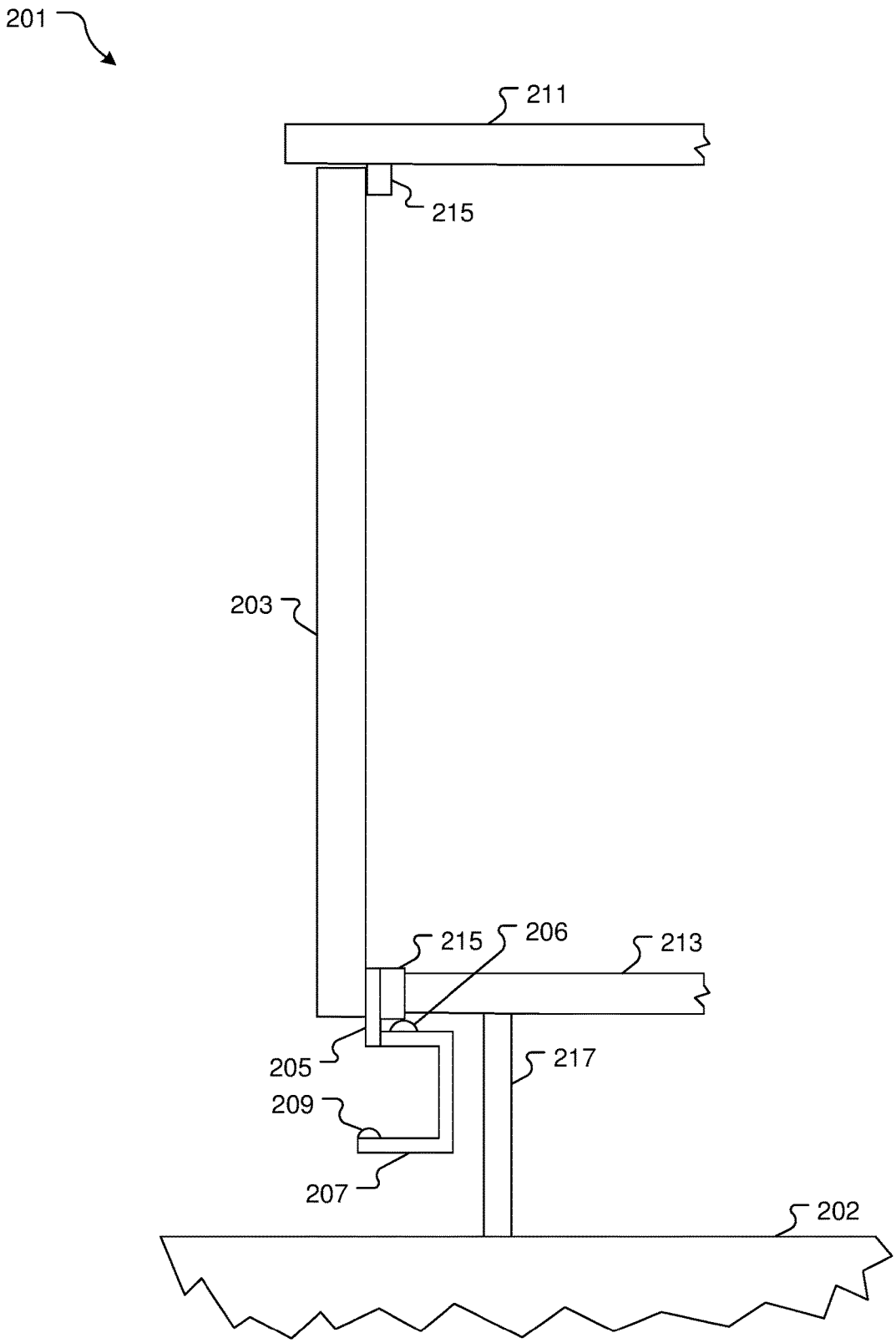
FIG. 2 is a side view of a concealed door opening system in accordance with a preferred embodiment of the present application.

Referring now to the drawings wherein like reference characters identify corresponding or similar elements throughout the several views, FIG. 2 depicts a side view of a concealed door opening system in accordance with a preferred embodiment of the present application. It will be appreciated that system 201 overcomes one or more of the above-listed problems commonly associated with conventional door opening systems.

In the contemplated embodiment, system 201 comprises a floor 202, a cabinet door 203, one or more attachment devices 205, one or more removable door stops 206, one or more foot brackets 207, one or more gripping means 209, one or more counter tops 211, one or more cabinet bottom panels 213, one or more cabinet front frames 215 and one or more cabinet toe kicks 217. In use gripping means 209, stop 206 and bracket 207 are held in communication with door 203 via attachment means 205 and force is applied to gripping devices 209 to displace cabinet door 203 from frame 215 to open cabinet space enclosed by counter top 211, and bottom panel 213.

It should be appreciated that one of the unique features believed characteristic of the present application is that force transmission structure 205 allows gripping means 209 to be attached to cabinet door 203 and not protrude from door 203, reducing the possibility of injury. It will also be appreciated that system 201 also does not eliminate clearance for feet and toes under cabinet door 203.

Another unique feature believed characteristic of the present application is that gripping means 209 can be used by the foot of a user. It will be appreciated that this allows the user to have both hands available to hold articles or otherwise work and still access what is behind cabinet door 203. It will also be appreciated that stop 206 assists in keeping door 203 closed and prevents the door 203 from being closed in a violent manner.

Figure 3:
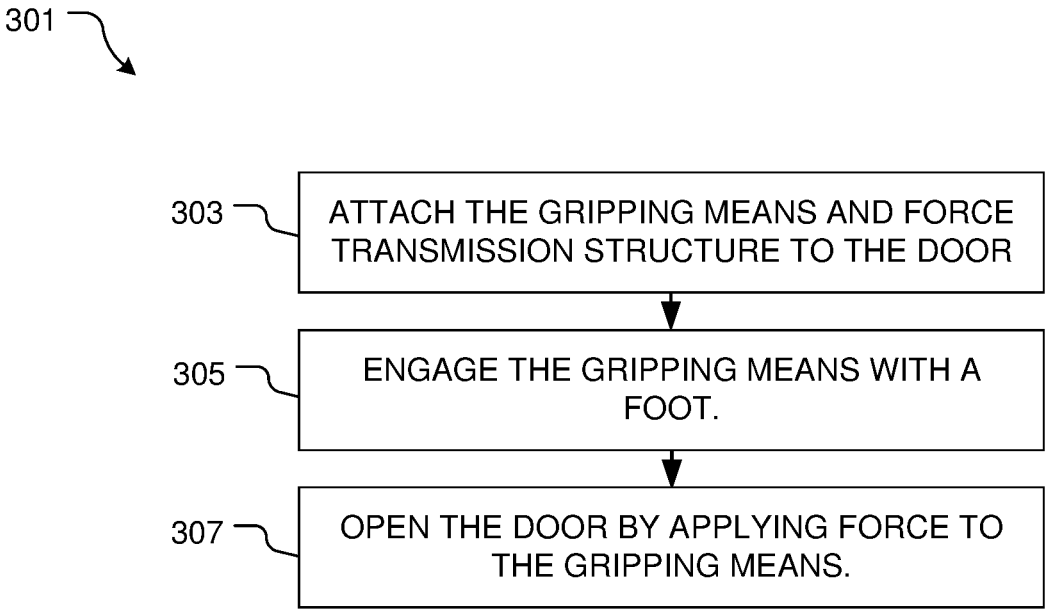
FIG. 3 is a diagram of the preferred method of use of the system of FIG. 2.

Referring now to FIG. 3 the preferred method of use of system 201 is depicted, method 301 comprising attaching the gripping means and force transmission structure to the door 303, engaging the gripping means with a foot 305 and opening the door by applying force to the gripping means 307.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A cabinet structure, comprising:

a frame having a plurality of panels;

a door pivotally secure to a panel of the plurality of panels, the door having a front surface and a back surface and a thickness formed therebtween;

a foot bracket secured to the door, the foot bracket forming a c-shaped structure having an opening configured to receive a foot therein, the foot bracket is secured to the back surface of the door and configured to remain behind the thickness of the door;

a door stop secured to an outer surface of the foot bracket and configured to engage with the frame and configured to secure the door in a locked positioned, the door stop extending from the outer surface of the foot bracket; and a foot grip disposed within the opening of the foot bracket and configured to engage with the foot.

* * * * *